US005607649A

United States Patent [19]

Hansen

[11] Patent Number: 5,607,649

[45] **Date of Patent: *Mar. 4, 1997**

[54] METHOD AND APPARATUS FOR PROCESSING A PARTICULATE MATERIAL IN A FLUIDIZED BED CHAMBER

[75] Inventor: Ove Hansen, Ravnsholtvej, Denmark

[73] Assignee: Niro Holding A/S, Soeborg, Denmark

[ * ] Notice: The terminal 26 months of this patent has been desclaimed.

[21] Appl. No.: 538,963

[22] Filed: Sep. 19, 1995

Related U.S. Application Data

[63] Continuation of Ser. No. 894,747, Jun. 5, 1992, abandoned.

[51] Int. Cl.[6] ..... F27B 15/08; F26B 3/00

[52] U.S. Cl. ..... 422/147; 422/139; 422/143; 34/360; 34/367; 34/371; 34/585; 34/591; 96/150; 95/108; 95/275; 55/266; 55/318; 55/334; 55/479

[58] Field of Search ..... 422/139, 143, 422/144, 147; 34/580, 367, 360, 591, 583, 473, 372, 359, 394, 579, 585, 516, 361, 491, 413, 468, 371, 582; 55/479, 315, 318, 324, 261, 266, 334, 341.1; 95/275, 107, 110, 290, 274, 108; 96/150

[56] References Cited

U.S. PATENT DOCUMENTS

| | | | |
|---|---|---|---|
| 1,635,012 | 7/1927 | Seel | 34/473 |
| 2,670,036 | 2/1954 | Spalding | 34/37.2 |
| 3,578,498 | 5/1971 | Kite et al. | 34/359 |
| 3,661,558 | 5/1972 | Heath et al. | 422/139 |
| 3,904,375 | 9/1975 | Calbeck | 34/580 |
| 3,942,958 | 3/1976 | Thompson et al. | 422/139 |
| 4,012,210 | 3/1977 | Morris | 55/479 |
| 4,054,424 | 10/1977 | Staudinger et al. | 34/394 |
| 4,085,516 | 4/1978 | Jukkola et al. | 34/360 |
| 4,305,210 | 12/1981 | Christensen et al. | 34/583 |
| 4,320,089 | 3/1982 | Hüttlin | 422/143 |
| 4,386,471 | 6/1983 | Bowrey et al. | 34/401 |
| 4,509,963 | 4/1985 | Jackson | 55/429 |
| 4,521,977 | 6/1985 | Gräff | 34/413 |
| 4,545,134 | 10/1985 | Mukerjee et al. | 34/468 |
| 4,567,674 | 2/1986 | Strohmeyer, Jr. | 34/591 |
| 4,621,437 | 11/1986 | Grande et al. | 34/361 |
| 4,640,023 | 2/1987 | Mori et al. | 34/583 |
| 4,832,700 | 5/1989 | Kaspar et al. | 34/580 |
| 5,120,691 | 6/1992 | Pontier et al. | 422/146 |
| 5,189,811 | 3/1993 | Rose et al. | 34/360 |

FOREIGN PATENT DOCUMENTS

| | | |
|---|---|---|
| 094172 | 11/1983 | European Pat. Off. . |
| 2366531 | 4/1978 | France . |
| 1365137 | 8/1974 | United Kingdom . |
| 2123936 | 2/1984 | United Kingdom . |

*Primary Examiner*—Robert J. Warden
*Assistant Examiner*—Hien Tran
*Attorney, Agent, or Firm*—Dennison, Meserole, Pollack & Scheiner

[57] ABSTRACT

An apparatus for processing a particulate material containing an inflammable component, such as ethanol or another solvent, comprises a fluidized bed chamber with a perforated bed plate arranged therein. The particulate material may be fluidized on the bed plate by supplying fluidizing air upwardly through perforations in the bed plate. In order to reduce the risk of explosion in the fluidizing air after its passage through the fluidized bed formed on the bed plate, dilution gas is fed into the fluidized bed chamber. The dilution gas is introduced into the fluidized bed chamber at least at one position spaced from the side walls of the chamber and preferably located centrally within the fluidized bed chamber in order to obtain a substantially uniform mixing of the dilution gas with the fluidizing air including the inflammable component immediately above the fluidized bed. The explosion safe gas mixture may be discharged from the upper part of the processing chamber.

20 Claims, 3 Drawing Sheets

Fig. 1
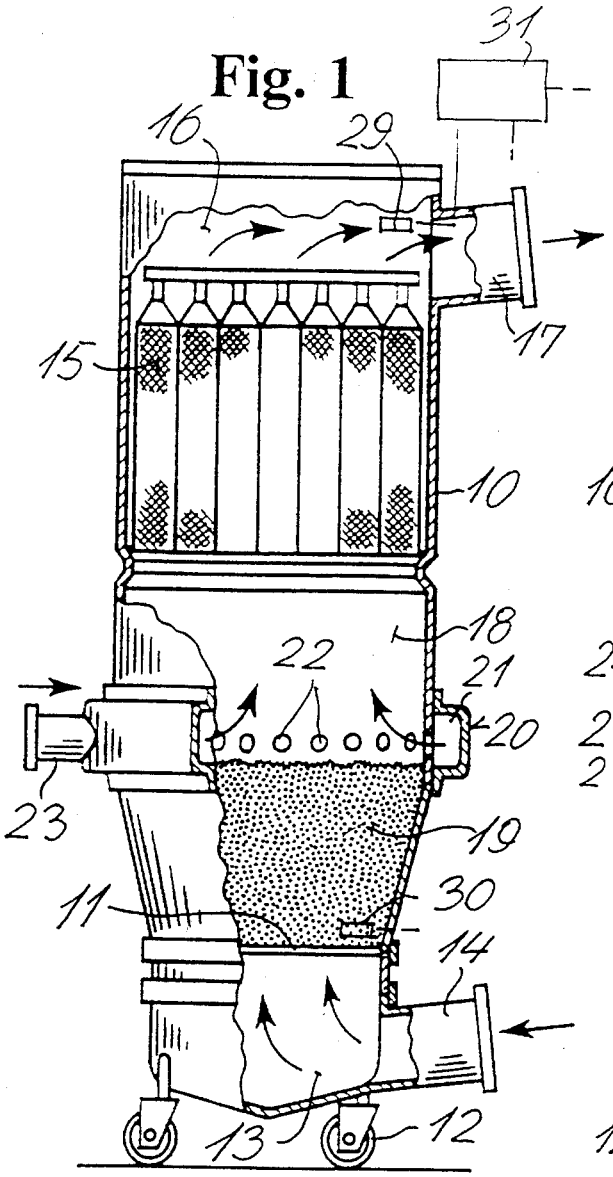
Fig. 2
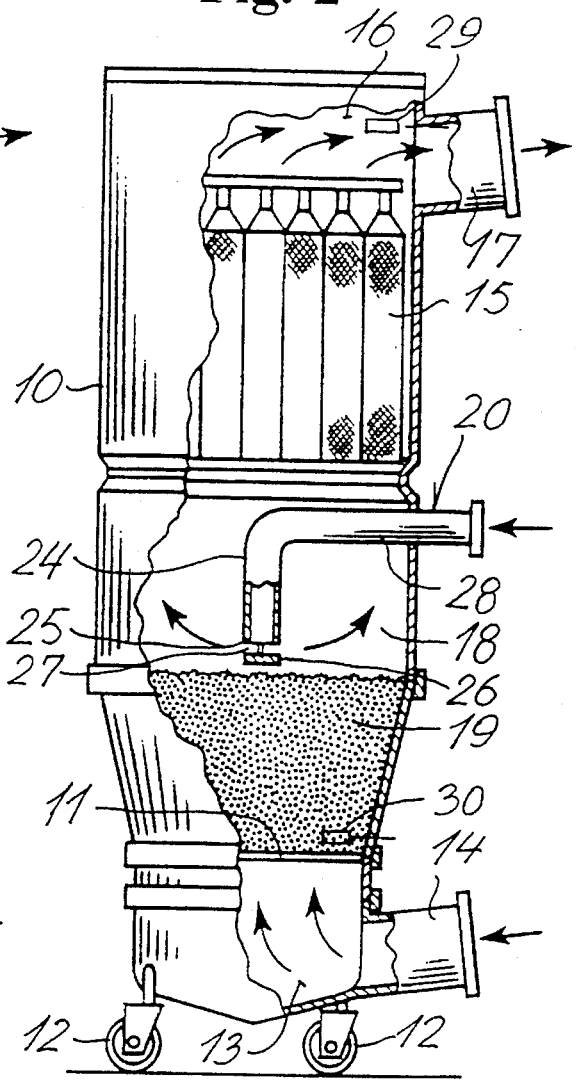
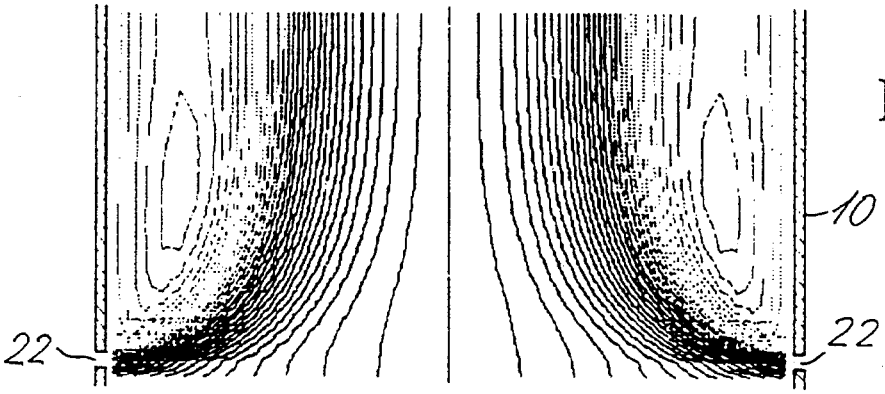
Fig. 3

METHOD AND APPARATUS FOR PROCESSING A PARTICULATE MATERIAL IN A FLUIDIZED BED CHAMBER

This is a continuation of application Ser. No. 07/894,747 filed on Jun. 5, 1992, now abandoned.

BACKGROUND OF THE INVENTION

1. Field of the Invention

The present invention relates to a method of processing a particulate material containing an inflammable component in a fluidized bed chamber.

As an example, the particulate material may be wet granules of tablet materials containing an inflammable component, such as alcohol, acetone, or another solvent, and possibly also water. When the wet granulated material is being dried and/or otherwise treated in the fluidized bed, part of the inflammable component is evaporated and mixed with the fluidizing gas, which is usually air or another oxygen containing gas. The mixture of the oxygen containing gas and the evaporated inflammable component may under certain circumstances be explosive or inflammable, so that an accidental spark caused for example by static electricity may give rise to an explosion or a fire.

2. Description of the Prior Art

It is well-known to prepare wet granules of a tablet material in a combined high speed mixer and granulator to which powdered solid components and liquid components may be added. The prepared batch of the wet granules is then transferred to a fluidized bed dryer, in which atmospheric air is used as fluidizing gas.

When the wet granules contain an inflammable liquid, such as alcohol, and the granules are transferred from the combined mixer and granulator to the fluidized bed dryer at an elevated temperature (during treatment in the combined mixer and granulator the temperature of the tablet material may increase to about 40° C. or even higher), the exhaust air leaving the fluidized bed may contain such a proportion of the inflammable component that a risk of explosion or ignition may exist, especially at the beginning of the drying process before the granulated material has been sufficiently cooled down due to adiabatic evaporation of the volatile inflammable component and due to contact with the normally cool fluidizing air, It is known to reduce or eliminate the risk of explosion by using an inert fluidizing gas, such as nitrogen or a low oxygen containing gas, in an open system in which the spent inert fluidizing gas is exhausted into the atmosphere, and in a closed system, in which the inert fluidizing gas is recirculated. However, both such known methods are rather uneconomic due to the heavy investments required for the equipment, or they may be unacceptable due to the risk of contamination.

SUMMARY OF THE INVENTION

The present invention provides a method and apparatus by means of which the risk of an explosion in connection with the processing of a particulate material containing an inflammable component in a fluidized bed may be efficiently eliminated or considerably reduced in a rather economic manner.

It has been proposed to introduce dilution air into the fluidized bed chamber above the fluidized bed through openings defined in the peripheral wall of the chamber.

However, as described below, examinations made by the inventor of the present invention indicate, that thereby it is possible to reduce the relative alcohol concentration in the fluidizing gas adjacent to the peripheral wall of the fluidized bed chamber while only a relative small proportion of the dilution gas is mixed with the fluidizing gas in the central area of the chamber. This means that it is not possible to obtain a substantially uniform mixing of the dilution gas and the fluidizing air over the total cross-sectional area of the fluidized bed chamber.

Thus, the present invention provides a method of processing a particulate material containing an inflammable component in a fluidized bed chamber being defined by side walls and having a perforated bed plate, said method comprising passing fluidizing oxygen containing air upwardly through the perforations of the bed plate for fluidizing the particulate material so as to form a fluidized bed on the bed plate and so as to carry off inflammable component from the particulate material, introducing dilution gas into the fluidized bed chamber at least at one position spaced from said chamber side walls and mixing the dilution gas with the fluidizing air and with the inflammable component above the fluidized bed, the amount of dilution gas introduced being sufficient to substantially reduce the explosion risk of the mixture containing oxygen and inflammable component, and discharging the gas mixture from the upper part of the fluidized bed chamber.

The dilution gas being introduced into the fluidized bed chamber and mixed with the fluidizing air reduces the proportion of the inflammable component in the mixture and thereby reduces the explosion risk. It has been found that the mixing of the dilution gas with the spent fluidizing air and the inflammable component is improved when the dilution gas flows outwardly from such a position which is spaced from the chamber side walls. If desired, dilution gas may additionally be introduced through one or more inlet openings defined in the side walls of the chamber.

The dilution gas introduced may, for example, be nitrogen or another inert gas. However, for economic reasons, the dilution gas is preferably atmospheric air.

The inflammable component contained in the fluidizable particulate material may be a gas which is absorbed or adsorbed by the particulate material. In the preferred embodiment, however the particulate material is made by mixing one or more powdered components with liquid comprising a volatile liquid, such as acetone or ethyl alcohol, or mixtures of such liquids with water. However, the inflammable component may, alternatively, comprise a solid powdered substance being composed by combustible particles which are so small that they are entrained by the fluidizing air flowing from the fluidized bed to the fluidizing air discharge.

The dilution gas or air may be introduced into and mixed with the fluidizing air in any suitable manner above and preferably immediately above the fluidized bed so as to not substantially interfere with the fluidized bed. In order to obtain a more uniform distribution of the dilution gas in the fluidized bed chamber, said at least one position of introducing dilution gas is preferably located centrally within such chamber. This means that one or more dilution gas outlets may be arranged centrally above a substantially circular or substantially square bed plate. When the bed plate has an elliptical or a rectangular outline or is of another oblong shape, one or more dilution gas outlets may be arranged in mutually spaced positions along a longitudinal symmetry axis and possibly also along a transverse symmetry axis.

The dilution gas may be directed outwardly into the fluidized bed chamber in one coherent or in several separated flows defining an annular pattern. It has been found that when the dilution gas is directed outwardly into the fluidized bed chamber in one or more outwardly directed flows a good mixing with the upwardly flowing fluidizing air may be obtained. It should be understood that any suitable type of mixing devices could be arranged within the fluidized bed chamber for improving a uniform mixing of the dilution gas with the spent fluidizing air.

The amount of inflammable component released from the particulate material may vary during the processing period. Usually, the amount of inflammable component released decreases as the processing proceeds. In order to maintain the proportion of the inflammable component of the gas phase within the processing chamber below a predetermined limit and more or less at a predetermined level, the flow of dilution gas introduced into the fluidized bed chamber may be controlled in response to the amount of inflammable component carried off from the particulate material. Thus, the concentration of inflammable component in the gas phase within the processing chamber may be currently measured by suitable sensing means, and the flow of dilution gas introduced may be increased when the proportion of inflammable component increases and vice versa. In the preferred embodiment, however, the flow of dilution gas introduced into the fluidized bed chamber is maintained substantially constant, while the flow of fluidizing air is being controlled so as to keep the concentration of inflammable component within predetermined limits. Additionally or alternatively, the flow of dilution gas may be controlled.

The particulate material may be introduced into the fluidized bed chamber in a hot condition, for example because it is supplied directly from a high speed mixer and granulator. When the particulate material contains a volatile, inflammable liquid component this means that a relatively high proportion of inflammable vapour is released from the particulate material during the first part of the processing period. In order to efficiently reduce the proportion of inflammable component dilution gas may be introduced into the fluidized bed chamber for a certain period of time prior to passing fluidizing air through the perforations of the bed plate. Thereafter, the flow of fluidizing air may be gradually increased till the desired maximum value has been reached without passing a predetermined concentration level of the inflammable component in the exhaust gas.

The release of inflammable component from the particulate material may also be controlled by controlling the temperature of the fluidizing air supplied to the fluidized bed chamber. As an example, the fluidizing air supplied may be below or at room temperature during the first part of the processing period, and when part of the inflammable liquid component has been vaporized from the particulate material, which is thereby cooled down, the temperature and/or the flow rate of the fluidizing air may be increased.

The gas mixture may be exhausted from the fluidized bed chamber at a rate so as to create a pressure within the fluidized bed chamber slightly below the atmospheric pressure so as to prevent leakage of gas through the walls defining said chamber.

The supply of dilution gas, the supply of fluidizing air, the temperature of the fluidizing air, and/or the exhaust rate of gas mixture may be controlled by suitable electronic control means, such as a microprocessor, whereby the relative content of inflammable component of the gas mixture may be kept below a predetermined safe value while the particulate material is being processed in the most efficient and economic manner.

According to another aspect, the present invention provides an apparatus for processing a particulate material containing an inflammable component, said apparatus comprising a fluidized bed chamber being defined by side walls and having a perforated bed plate arranged therein, means for supplying particulate material to be processed on to the bed plate, means for supplying fluidizing air upwardly through the bed plate so as to fluidize the particulate material thereon, means for feeding dilution gas into the fluidized bed chamber and for mixing the dilution gas with the fluidizing air above, and preferably immediately above the fluidized bed formed on the bed plate, the dilution gas feeding and mixing means comprising at least one dilution gas outlet spaced from the chamber side walls, and means for discharging the gas mixture from the upper part of the fluidized bed chamber.

The dilution gas feeding and mixing means are preferably located immediately above the fluidized bed and preferably positioned centrally within the fluidized bed chamber. The said at least one dilution gas outlet may comprise one or more outlet openings or nozzles which are directed outwardly and transversely to the upwardly directed fluidizing air flow. Furthermore, the feeding and mixing means may comprise any type of baffles or impellers or other mixing means promoting a uniform mixing of the dilution gas with the upwardly flowing fluidizing air.

The dilution gas outlet, which may define a substantially annular outlet opening, may, for example, be defined between a lower edge of a downwardly extending axial supply tube and a cover plate axially spaced therefrom.

The gas mixture discharging means may comprise a filtering device of any type for filtering solid particles from the gas mixture being discharged, and the filtering device may, for example, comprise one or more bag filters.

The method and apparatus according to the invention are applicable not only for drying a particulate material containing an inflammable component, but also for any other kind of processing a particulate material in a fluidized bed, such as granulating. Furthermore, the invention is applicable not only in connection with fluidized bed apparatuses to which the particulate material is fed batchwise, but also to fluidized bed apparatuses to which the particulate material is fed and discharged continuously. The latter type of fluidized bed apparatuses may be of the back mixed type which may be connected to a further fluidized bed apparatus of the plug-flow type.

BRIEF DESCRIPTION OF THE DRAWINGS

The invention will now be further described with reference to the drawings, wherein FIG. 1 is a side view and a partially sectional view of a fluidized bed apparatus in which dilution air is introduced through openings defined in the peripheral wall of the fluidized bed chamber, FIG. 2 is a side view and partially sectional view of an embodiment of the fluidized bed apparatus according to the invention, FIG. 3 is a copy in black and white of a colored computer simulated flow distribution pattern in the fluidized bed apparatus shown in FIG. 1.

DESCRIPTION OF PREFERRED EMBODIMENTS

Figure 4:
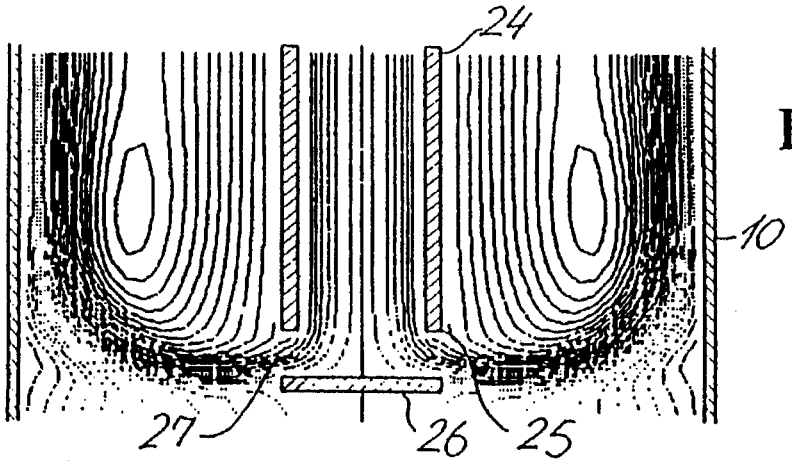
FIG. 4 is a flow distribution pattern corresponding to that shown in FIG. 3 in the apparatus shown in FIG. 2.

FIG. 1 diagrammatically illustrates a fluidized bed apparatus comprising an upright housing 10 having a substantially horizontal bed plate 11 arranged in its lower end portion. The upper part of the apparatus may be stationarily suspended while the lower part of the apparatus containing the particulate material to be fluidized and a plenum chamber 13 is movable by means of rollers or wheels 12 which are mounted at the lower end of the housing 10. The plenum chamber 13 having an inlet 14 for fluidizing air is defined in the lower end of the housing 10 below the bed plate 11. A filtering device 15 which may, for example, comprise a number of bag filters, is arranged within a filtering chamber 16, which is defined in the upper end of the housing 10, and from which gas may be discharged through an outlet 17 communicating with the filtering chamber 16 above the filtering device 15. A fluidized bed chamber 18 is defined in the housing 10 between the bed plate 11 and the filtering device 15. This fluidized bed chamber 18 may contain a fluidized bed 19 positioned above the bed plate 11 and formed by a fluidized particulate material.

Dilution air or gas may be introduced into the fluidized bed chamber 18 immediately above the fluidized bed 19 by means of a dilution gas supply and mixing device 20. In FIG. 1 the supply and mixing device 20 comprises an annular manifold chamber 21 encircling the fluidized bed chamber 18. The manifold chamber 21 communicates with an annular pattern of peripherally spaced openings 22 formed in the peripheral wall of the housing 10 immediately above the fluidized bed 19. Dilution gas or air may be supplied to the manifold chamber 21 through an inlet 23.

The fluidized bed apparatus shown in FIG. 2 corresponds to that shown in FIG. 1, and corresponding apparatus parts have been designated by the same reference numerals. However, in the accordance with the present invention the dilution gas supply and mixing device 20 shown in FIG. 2 comprises a tube section 24 extending axially and centrally downwardly within the fluidized bed chamber 18. The tube section 24 has an open end 25 closely spaced from the upper surface of the fluidized bed 19. The end opening of the tube section 24 is covered by a cover plate 26 which is axially spaced from the open end 25 of the tube section 24 so as to define an annular, substantially axially directed nozzle opening 27 between the open end 25 of the tube 24 and the cover plate 26 distributing the dilution gas in a circumferential pattern. Dilution gas or air may be supplied to the axial tube section 24 through an inlet 28 and as shown in FIG. 2 the tube section 24 and the inlet 28 may together form a tube bend.

The apparatuses shown in FIGS. 1 and 2 may be operated as follows:

When a batch of a particulate material containing an inflammable component, such as ethyl alcohol or ethanol, has been arranged on the bed plate 11, dilution air or gas may be supplied to the inlets 23 and 28, respectively, while gas is withdrawn from the filtering chamber through the outlet 17, for example by means of a suction fan (not shown) communicating therewith. The dilution gas or air may also be supplied to the inlets 23 or 28 by means of a pressure fan (not shown) or another pressurized gas source. At the same time or after a certain purge period cool fluidizing air may be supplied to the plenum chamber 13 through the inlet 14 from a suitable pressurized air source, such as a pressure fan, whereby the particulate material on the bed plate 11 is eventually fluidized so as to form the fluidized bed 19. The dilution gas flowing radially into the fluidized bed chamber 18 through the openings 22 and the nozzle opening 27, respectively, is mixed with and dilutes the fluidizing air having passed the fluidized bed 19 and having received an inflammable component therein so that the risk of ignition and explosion of the gas mixture is eliminated or substantially reduced. The diluted gas mixture being exhausted through the outlet 17 is filtered in the filtering device 15. The relative amount of the inflammable component contained in the gas mixture exhausted through the outlet 17 may be sensed by means of a sensing device 29, and the temperature of the particulate material on the bed plate 11 may be sensed by means of a temperature sensing device 30. The operation of the apparatuses shown in FIGS. 1 and 2 may be controlled by means of an electronic control device 31, such as a microprocessor, which may receive measuring signals from the sensing devices 29 and 39 and from possible other detectors.

FIG. 3 illustrates the gas flow pattern within the upper part of the fluidized bed chamber 18 of the apparatus shown in FIG. 1, while FIG. 4 illustrates the corresponding flow pattern within the apparatus according to the invention shown in FIG. 2. The illustrations in FIGS. 3 and 4 have been obtained by computer simulation using the software FLUENT supplied by Fluent Inc., Hanover, N.H., USA (formerly Creare. X Inc.).

The flow pattern shown in FIG. 3 has been generated by computer numeric simulation of a situation where the inner diameter of the fluidized bed chamber 18 above the fluidized bed is 1.28 m, while the velocity of the fluidizing air in the fluidized bed is 1.165 m/sec with an air flow of 6138 kg/h. The velocity of the dilution air flowing in the fluidized bed chamber 18 through the openings 22 is 15 m/sec, and the amount of dilution air is 6890 kg/h. The alcohol concentration in the fluidizing air having passed the fluidized bed 19 is set to 0.1 kg/kg dry air, and in case of complete mixing of dilution gas and fluidizing air the alcohol concentration is calculated to be 0.0471 kg alcohol/kg dry air.

The computer simulated flow pattern shown in FIG. 4 is based on an apparatus of the type shown in FIG. 2, where the inner diameter of the fluidized bed chamber 18 above the fluidized bed 19 is 1.28 m, the velocity of the fluidizing air in the fluidized bed is 1.165 m/sec., and the fluidizing air is supplied in an amount of 6138 kg/h. Dilution air is supplied though the axial tube section 24 at a velocity of 22 m/sec and in an amount of 4181 kg/h. The dilution air is flowing outwardly through the annular nozzle opening 27 at a velocity of 15.3 m/sec.

Figure 5:
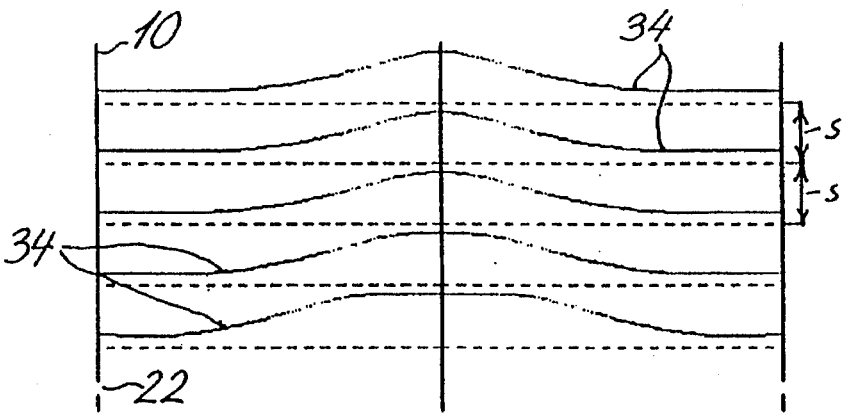
FIG. 5 is a representation showing at various levels the variation in alcohol concentration along a diameter of the fluidized bed chamber of the apparatus shown in FIG. 1.
Figure 6:
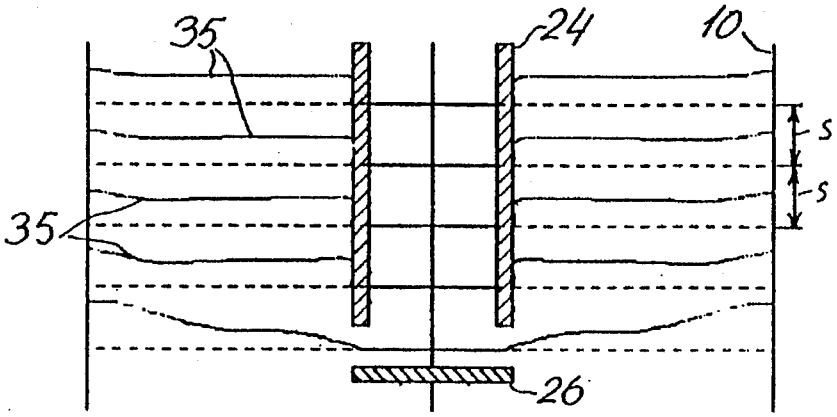
FIG. 6 is a representation as that in FIG. 5 for the apparatus shown in FIG. 2.

The variation in alcohol concentration in the fluidized bed chamber 18 of the apparatuses shown in FIGS. 1 and 2 is illustrated also in FIGS. 5 and 6, and these illustrations are based on the numeric values obtained by the computer simulation described above in connection with FIGS. 3 and 4. In FIGS. 5 and 6 the variation in alcohol concentration diametrically across the circular fluidized bed chamber 18 is shown by graphs 34 and 35, respectively, at various uniformly axially spaced levels (indicated by broken lines). The mutual axial spacing "s" of the levels corresponds to an alcohol concentration of 0.1 kg alcohol/kg dry air. This means that the vertical distance between each of the horizontal broken lines and the adjacent graph thereabove indicates the fractional alcohol concentration at the respective location.

From FIGS. 5 and 6 it is apparent that in the apparatus shown in FIG. 1 the dilution air is not mixed uniformly with the fluidizing air, especially not in the central region of the fluidized bed chamber 18. In the apparatus according to the invention shown in FIG. 2 a much more uniform mixing of dilution gas and fluidizing air is obtained across the cross-sectional area of the chamber 18. This is also evident from FIGS. 3 and 4.

EXAMPLE 1

A fluidized bed apparatus of the type shown in FIG. 2 was used for drying a wet, granulated material containing ethyl alcohol in order to demonstrate that it was possible to keep the peak concentrations of alcohol below a predetermined safety level.

3 lots each consisting of 13.6 kg of hydrous lactose and 2.4 kg of starch were mixed with 3 kg water and 1 kg of ethyl alcohol and granulated in a high speed mixer and granulator. These three lots having a total weight of 60 kg and a temperature of about 22° C. were transferred to the fluidized bed apparatus. For the first 5 minutes of the processing time no fluidizing air was passed through the batch of particulate material arranged on the fluidized bed 11 and air was fed into the fluidized bed chamber 18 only through the tube section 24 by means of a fan. At the same time air was discharged through the outlet 17 by means of an exhaust fan so as to create a subatmospheric pressure within the fluidized bed chamber 18 so as to prevent leakage through the walls of the fluidized bed chamber 18. After completion of the purge cycle during the first 5 minutes, fluidizing air was allowed to be drawn from the plenum chamber 13 upwardly through the perforations of the bed plate 11 and through the layer of particulate material to be fluidized. The temperature of the fluidizing air supplied to the plenum chamber 13 was initially 12° C., and this temperature was increased to 40° C. as soon as the particulate material was fluidized. The material fluidized 15 minutes after starting processing of the particulate material within the fluidized bed apparatus. The flow of dilution air supplied through the tube section 24 was substantially constant during the entire process, and the flow of fluidizing air supplied to the plenum chamber 13 was approximately the same so that half of the air supplied to the fluidized bed chamber 18 was fed through the tube section 24 and half of the air was fed through the plenum chamber 13.

Figure 7:
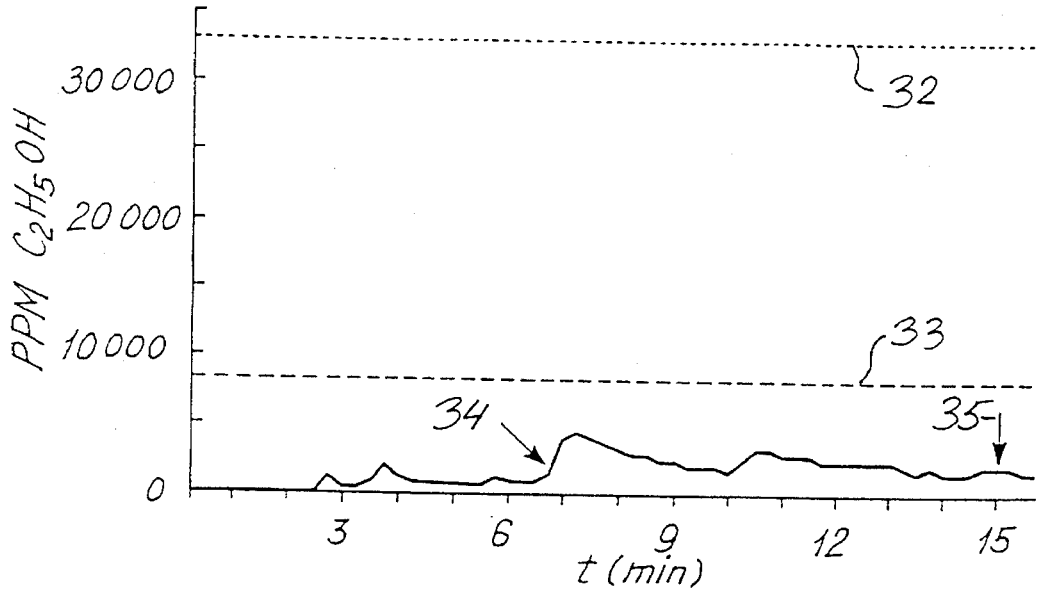
FIG. 7 is a graphic representation in which the contents of ethyl alcohol in the gas mixture discharged from a fluidized bed apparatus as that shown in FIG. 2 is plotted versus the processing time.

FIG. 7 is a graphical representation showing the concentration of ethyl alcohol in the air exhausted through the outlet 17 and plotted versus the processing time in the fluidized bed apparatus. In this graphical representation the lower explosion limit for ethanol at 33,000 ppm and a safety level at 8250 ppm are indicated by broken lines 32 and 33, respectively. From FIG. 7 it is apparent that the concentration of alcohol in the exhaust air did not exceed the safety level 33 during processing in the fluidized bed apparatus. In FIG. 7 the arrows 34 and 35 indicate the start of supplying fluidizing air and the time where fluidization has been obtained, respectively.

EXAMPLE 2

Figure 8:
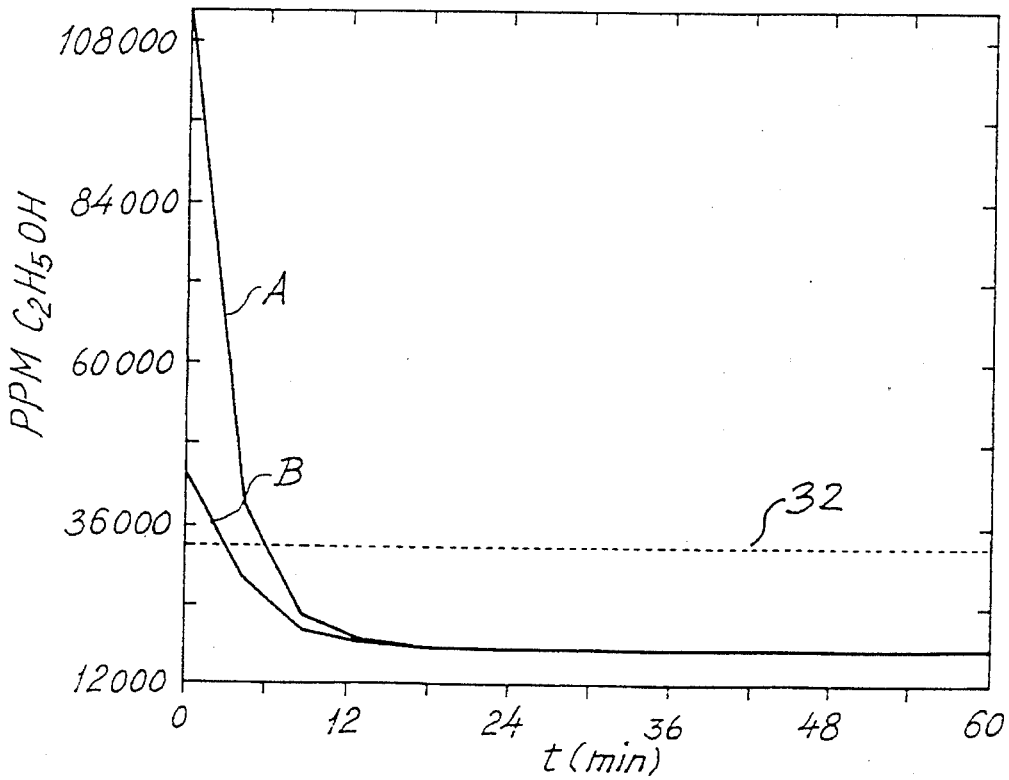
FIG. 8 is a graphic representation corresponding to that shown in FIG. 7, but when no dilution air is introduced into the apparatus.

Similar tests were made by using a wet particulate material containing equal amounts of water and ethyl alcohol. In a first test, the particulate material was transferred directly from the mixer and granulator into the fluidized bed apparatus at a temperature of about 40° C. The material was processed and dried in a conventional manner without supplying dilution air through the tube section 24. The graph A in FIG. 8 shows the calculated concentration profile of ethanol in the exhaust air in response to the processing time. It is noted that during the first 6 minutes the concentration of ethanol in the discharge air has far exceeded the lower explosion limited for ethanol, which means that an explosion could occur for example due to a spark caused by static electricity in the filtering device 15.

In a similar test, the particulate material was cooled to a temperature of 22° C. before it was charged to the fluidized bed apparatus. The graph B in FIG. 8 shows the calculated concentration profile of ethanol in the discharge air during processing. It is noted that during the first few minutes of the processing the concentration of ethanol exceeds the lower explosion limit 32, and the concentration of ethanol is above the safety level 33 indicated in FIG. 7 during the complete processing.

It should be understood that various amendments and modifications may be made in the embodiment shown in FIG. 2 of the drawings and described above. Thus, the temperatures and the amounts of dilution and fluidizing air or gas supplied may be controlled so as to maintain the concentration of the inflammable component below a desired level while at the same time obtaining the best possible processing conditions from an economic point of view. Furthermore, the cross-sectional shape of the fluidized bed chamber 18 may have any round or elongated shape, such as square, rectangular, elliptical, etc. The central tube section 24 may then be replaced or supplemented by two or more such tube sections arranged centrally or along one or two symmetry axes of the chamber cross-section. Such tube sections 24 may also be combined with peripheral openings 22 as shown in FIG. 1.

I claim:

1. A method of processing a particulate material containing an inflammable component presenting an explosion risk in a fluidized bed chamber, said method comprising supplying particulate material to a fluidized bed chamber defined by side walls and having a bed plate defining perforations therein, passing fluidizing oxygen-containing air upwardly through the perforations of the bed plate for fluidizing the particulate material so as to form a fluidized bed on the bed plate and so as to carry off an inflammable component from the particulate material, introducing dilution gas into the fluidized bed chamber above the fluidized bed, and mixing the dilution gas with the upwardly passing fluidizing air and with the inflammable component entrained thereby above the fluidized bed, the dilution gas being introduced into the fluidized bed chamber at least at one position spaced from said chamber side walls in a direction outwardly into the chamber and substantially transverse to the upwardly passing fluidizing air from said at least one position toward said side walls, in a circumferential pattern, so as to form a gas mixture which is substantially uniform over a horizontal cross section of the fluidized bed chamber, the amount of dilution gas introduced being sufficient to substantially reduce the explosion risk of the gas mixture containing oxygen and inflammable component, and discharging the gas mixture from an upper part of the fluidized bed chamber.

2. A method according to claim 1, wherein the dilution gas is air.

3. A method according to claim 1, wherein the dilution gas is introduced into the fluidized bed chamber immediately above the fluidized bed.

4. A method according to claim 1, wherein the inflammable component is a volatile liquid.

5. A method according to claim 4, wherein the volatile liquid is ethyl alcohol.

6. A method according to claim 1, wherein said at least one position is located centrally within the fluidized bed chamber.

7. A method according to claim 1, wherein the flow of dilution gas introduced into the fluidized bed chamber is controlled in response to the amount of inflammable component carried off from the particulate material.

8. A method according to claim 1, wherein the flow of dilution gas introduced into the fluidized bed chamber is maintained substantially constant, the flow of fluidizing air being controlled so as to keep the inflammable component within predetermined concentration limits.

9. A method according to claim 1, wherein the particulate material is introduced into the fluidized bed chamber at a temperature of at least 40° C.

10. A method according to claim 1, wherein dilution gas is introduced into the fluidized bed chamber for a period of time prior to passing fluidizing air through the perforations of the bed plate.

11. A method according to claim 1, wherein the release of inflammable component from the particulate material is controlled by controlling fluidizing air temperature.

12. A method according to claim 1, wherein the gas mixture is exhausted from the fluidized bed chamber at a rate so as to create a pressure within the fluidized bed chamber slightly below the atmospheric pressure so as to prevent leakage of gas through the side walls defining said chamber.

13. An apparatus for processing a particulate material containing an inflammable component, said apparatus comprising a fluidized bed chamber being defined by side walls and having a perforated bed plate arranged therein, on which a particulate material is to be fluidized, means for supplying fluidizing air upwardly through the bed plate so as to fluidize the particulate material thereon to form a fluidized bed, means for feeding dilution gas into the fluidized bed chamber and for mixing the dilution gas with the fluidizing air above the fluidized bed formed on the bed plate, the dilution gas feeding and mixing means comprising a means defining a substantially annular dilution gas outlet opening directed transversely to an upward direction in the chamber, positioned centrally within the fluidized bed chamber and spaced from the chamber side walls, so as to obtain a substantially uniform gas mixture over a horizontal cross-section of the chamber and means for discharging the gas mixture from an upper part of the fluidized bed chamber.

14. An apparatus according to claim 13, wherein the gas feeding and mixing means are located immediately above the fluidized bed.

15. An apparatus according to claim 13, wherein the dilution gas outlet opening is defined between a lower edge of a downwardly extending axial supply tube and a cover plate axially spaced therefrom.

16. An apparatus according to claim 13, wherein the gas mixture discharging means includes a filtering device for filtering solid particles from the gas mixture being discharged.

17. An apparatus according to claim 16, wherein the filtering device comprises a bag filter.

18. An apparatus according to claim 13, further comprising sensing means for sensing inflammable component proportion in the fluidizing bed chamber, particulate material temperature or both, and control means for controlling operation of the apparatus in response to measuring signals received from the sensing means.

19. An apparatus according to claim 18, wherein the sensing means is constructed and arranged to sense the temperature of the particulate material in the fluidized bed.

20. An apparatus according to claim 18 or 19, wherein the control means is constructed and arranged to control at least one parameter selected from the group consisting of the supply of dilution gas, the supply of fluidizing air, the temperature of the fluidizing air, and the discharge of gas mixture.

* * * * *